US006227925B1

(12) United States Patent
Boddy

(10) Patent No.: US 6,227,925 B1
(45) **Date of Patent: *May 8, 2001**

(54) FLOTATION DEVICE

(76) Inventor: Graeme James Boddy, 77 Eastern Terrace, Christchurch (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 09/351,386

(22) Filed: Jul. 13, 1999

Related U.S. Application Data

(63) Continuation-in-part of application No. 09/254,565, filed as application No. PCT/NZ97/00113 on Mar. 8, 1999, now Pat. No. 6,155,899.

(30) Foreign Application Priority Data

Sep. 13, 1996 (NZ) ..... 299373
Jul. 13, 1998 (NZ) ..... 330979

(51) Int. Cl.[7] ..... B63C 9/08
(52) U.S. Cl. ..... 441/129
(58) Field of Search ..... 114/345, 363; 441/129–132, 35, 40

(56) References Cited

U.S. PATENT DOCUMENTS 1,555,589 * 9/1925 Farina ..... 441/132
2,698,447 * 1/1955 Potts et al. ..... 114/345
4,771,222 * 9/1988 Tihany ..... 114/345
4,894,033 * 1/1990 Chang ..... 441/40
5,171,178 * 12/1992 Creek et al. ..... 441/132
5,186,667 * 2/1993 Wang ..... 441/129

* cited by examiner

*Primary Examiner*—Ed Swinehart
(74) *Attorney, Agent, or Firm*—Ross, Ross & Flavin

(57) ABSTRACT

A substantially rigid or semi-rigid chair suitable for white-water use with a hydrodynamically efficient underwater profile, capable of efficient human propulsion, using hands and/or legs, which supports the user in a semi-reclining position and which is sufficiently maneuvrable, in both forward and reverse direction, to enable the user to engage in white-water river use. In one embodiment, the chair consisting of two floats (2, 3), rigid/semi-rigid seat base (4), bow hull floor section (12) an adjustable seat back (8) and a waterproof covering (7). The floats (2, 3) are separated by a rigid/semi-rigid central section (15) comprised of the seat base (4), bow hull floor section (12) which extends from the bow (6) for a majority of the chair's length, and together with the seat back (8) providing a semi-reclining body position enabling the user to use hands and/or legs for propulsion/maneuvring.

29 Claims, 9 Drawing Sheets

FLOTATION DEVICE

This application is a continuation-in-part of the U.S. National Phase entry of PCT Application No. PCT/NZ97/00113, filed in the U.S. on Mar. 8, 1999, application Ser. No. 09/254,565, now U.S. Pat. No. 6,155,899.

TECHNICAL FIELD

The present invention relates to an improved float or chair for aquatic use. The float or chair is specially useful for recreational use on white-water rivers, though it will be appreciated that the chair could readily be used on any other body of water.

At present, personal flotation devices, fishing-floats, swimming-aids and white water canoes/catamarans are well known. However, all these known flotation means are configured for use in a specific manner and do not meet requirements addressed by the present invention.

BACKGROUND ART

Known inflatable craft suitable for white-water use can be generally categorised as canoes/kayaks, catamarans, or rafts, although there is a degree of overlap with some hybrid craft.

Typical inflatable canoes or kayaks are approximately symmetrical about their lateral and longitudinal axes, with enclosed sterns, and utilise oars or paddles for propulsion. Although the use of hands is a possible alternative, it is impractical to use feet/leg power for manoeuvring and propulsion. Entry to, or exit from the canoe to the water is hindered by the inflatable tube forming the whole perimeter.

An intrinsic feature of canoe design is that they are very long in relation to their width, and thus somewhat constrained in their ability to manoeuvre in confined areas.

Catamarans with inflatable hulls, such as disclosed in U.S. Pat. No. 5,290,196, whilst enabling unobstructed access into and out of the seating position, require a rigid tubular frame to form the seat and secure the hulls. Although the seat can be folded flat to facilitate overland transport, via attached shoulder straps, the float is primarily intended for flat-water use, in particular for fishing/hunting:—the seating position is high, relative to the hulls, and would be precarious for white-water sue, given the relatively short hulls.

Inflatable catamarans capable of white-water use are required to be substantially bigger to achieve the required stability as the operator is sitting at a significant height above the water surface.

In order to obtain sufficient stability to minimise the risk of capsize together with the associated structural requirements, such craft tend to be substantial, expensive, cumbersome and unwieldy. In contrast to the kayaks/canoes, foot propulsion on catamarans is possible, but the width of the inflatable hulls and the height of the occupant above the water inhibit practical use of the hands and thus oars are generally utilised.

White-water rafts formed from a continuous inflatable tube in an elongated annular shape, with a rigid, semi-rigid or flexible floor, are well-known. They generally require several users, equally distributed on each side of the raft using paddles to propel and steer effectively. Again, foot propulsion is impractical.

Several types of floats suitable for non-white-water use are known, such as ring floats, tubes, horseshoe floats, chairs and pool floats/toys.

Annular inflatable tubes used by fisherman to access areas of a lake or stream unreachable from the shore are typically formed form a car tire inner tube (or similar) covered by a fabric sleeve. A fabric seat is suspended from the ring allowing the whole of the lower torso to be submerged in the water an supporting the user in an upright position. Waders and swim fins are used by the fisherman in conjunction with this type of float. A drawback of such designs is the difficulty in getting in and out of the tube (especially when suitable attired for fishing) both ashore and following a puncture in the air bladder whilst in water.

The seating position is hydrodynamically inefficient and exposes the user's lower torso to underwater hazards, thus making white-water use in shallow rivers impractical.

Variations on annular inflatable designs are disclosed in U.S. Pat. No. 4,601,667, and NZ patent No. 61408. These all teach a seating position which may be maintained above the water, allowing just the lower legs to be submerged. Neither of these floatation devices has an efficient hydrodynamic shape or is suitable for white-water use due to the risk of injury from underwater obstructions. Ease of entry and exit from the water is again problematic.

U.S. Pat. No. 5,474,481, (continuation-in-part from No. 5,297,979) discloses a "diving well" inside the perimeter of the inflatable tube, with an elevated seating position with just the lower legs capable of immersion. The hull shape is however, restricted to an ovoid/annular shape. This configuration prevents the efficient, unrestricted use of flippers and due to the relatively large width of the float, hand propulsion is impractical, necessitating the use of cars and/or a motor.

To obviate some of the problems posed by such annular shaped floats, a number of horseshoe or "U" shaped-floats have been developed.

U.S. Pat. No. 5,217,400 discloses a U-shaped float formed by a single continuous tube with a flexible seating platform attached between the legs of the U. A tensioning strap attached to the end of the legs extends around the outside perimeter of the float. This strap is required to prevent the opposing legs collapsing towards each other under the weight of the user in the seat. Furthermore, the underwater profile of the hull makes no concession to hydrodynamic efficiency. The seating position is upright, being configured primarily to permit the user to engage in stationary activities such as fishing or hunting, rather than being optimised as a means of transport on the water. No protection would be available to the user's lower body in shallow and/or white-water, from any sub-surface hazards and the float has insufficient length relative to its width to provide stability in turbulent water.

The above mentioned requirement to maintain the structural integrity of an open-ended float has been addressed by differing means as disclosed in the following patents and designs:

- U.S. design Pat. No. 341,866 employs a "V" shape using a single tube of generally circular cross section, with substantially more volume (and therefore buoyancy) in the apex of the V. The seat appears to be composed of a simple mesh fabric. The angular divergence of the two "hulls" gives some structural resistance to the weight of the user in the seat. Again, there is no consideration of the hydrodynamic efficiency of the hull form, nor to the protection of the user from submerged obstructions/hazards. In particular, the blunt shape of the region of the "V" together with the increased volume both contribute to reduce the directional stability and the potential speed of the float.
- U.S. design Pat. No. 355,466. This design incorporates a lateral bar spanning the open end of a U-shaped float.

U.S. design Pat. No. 349,744. Similar to U.S. design Pat. No. 355,466 but without the rear cross-member and with the inclusion of an additional seating well in the bow.

Both U.S. design Pat. No. 355,466 and U.S. design Pat. No. 349,744 have generally circular cross-sectional float tubes and a flat seat, parallel with the water surface, and appear to be designed for use as a recreational toy in swimming pools or similar non-dynamic environments. The proportions of both designs would provide virtually no upper body support for a user positioned to be able to immerse their legs from below the knee for paddling.

U.S. design Pat. No. 362,706. This shows a rectangular fishing float with a centrally-mounted rigid seat and a rectangular cut-out to enable the fisherman's lower legs to dangle in the water. The whole shape of this design is clearly not intended to minimise the friction of the hull through the water.

None of the above referenced patents/designs display any rocker at any of the sides/ends of the floats, with the profile of the underside being substantially parallel to the water's surface.

U.S. Pat. No. 1,465,790. This is a non-inflatable U-shaped float in which the users legs and lower torso are submerged during use. A seat suspended from the centre of the "U" holds the user in an upright position.

U.S. Pat. No. 1,503,624. This discloses a rigid, non-inflatable U-shaped float, with which the user adopts a prone position with their arms extending outside and to the front of the float. This permits a swimming action to be carried out with both the arms and legs. The whole of the user's lower torso is submerged in the water.

There are also various miscellaneous floats, which do not fall into the previously described categories, which are broadly relevant.

U.S. Pat. No. 3,543,712 teaches a swimming aid which is contoured on its upper surface to match the upper torso of the user, thus leaving the arms and the body below the hips free to move. The user adopts a prone position and can utilise means of powered proportion incorporated in the float, in addition to the arm and leg swimming action.

While some lateral stability is provided by the longitudinal "keel-like" underwater projections, the float would afford little protection to the user in a white-water environment.

U.S. Pat. No. 5,186,667. This floating hammock places the user in a face-up, reclining seating position. However, it is clearly not intended to facilitate any means of user propulsion and indeed, incorporates supports/rests for both the arms and feet. The user's midriff is immersed in water entering a via lateral openings in the side of the hammock. The float does not have an open transom, contains little structural integrity and is not robust enough for white-water use.

U.S. Pat. No. 5,360360. This inflatable device is specifically intended for towing, both on the water and over snow. While the general appearance of the hull is U-shaped, the user or users is/are intended to sit/kneel/stand behind the side-walls. These walls are designed to provide protection from the effects of the elements whilst being towed. The underside of the float is flat and is intended to skim the surface of the water/snow rather than for human propulsion. While leg propulsion would be possible when not under tow, paddling by hand would be hindered due to the relatively high sides of the float.

An inflatable construction aids the transport and storage of the device when not in use by enabling the volume of the device to be greatly reduced by the deflation of the inflatable float(s). However, commercial rafting companies often prefer to avoid the time and inconvenience involved in inflating/deflating each craft for each trip. Instead, the crafts normally remain in a permanently inflated state and are transported to the launch site stacked on and secured to a trailer. Therefore, to meet such a need, a further embodiment of present invention seeks to retain the advantages and characteristics of the said floatation device disclosed in the U.S. National Phase entry of PCT Application No. PCT/NZ97/00113, filed in the U.S. on Mar. 8, 1999, whilst at least partially replacing the inflatable construction with a semi-rigid or rigid construction.

This embodiment of present invention would also be applicable to individual users unconcerned with the space-saving advantages of inflatable construction and desiring a cheaper but still robust embodiment of the said inflatable chair. Utilizing a semi-rigid/rigid construction enables a variety of float shaped to be readily implemented which would be too difficult and/or expensive to be practically produced with an inflatable construction. It further enables the whole craft to be produced as a single semi-rigid/rigid unit, thus obviating the construction and manufacture costs of the component elements required to make the inflatable chair. A simplified version of such a craft may be employed as a pool toy or for similar amusement/recreational purposes.

DISCLOSURE OF INVENTION

It is an object of the present invention to provide a float with a hydrodynamically efficient underwater profile, capable of efficient human propulsion, using hands and/or legs, which secures the user in a semi-reclining position and which is sufficiently manoeuvrable, in both forward and reverse direction, to enable the user to engage in white-water river use whilst protecting the user's body and minimising the risk of snagging the lower surface on under water hazards.

The dimensions and proportions of the float are chosen with the object of providing high longitudinal stability in turbulent water.

It is a further object of the present invention, to engender in the user of a feeling of close, direct involvement with the environment, by virtue of close proximity of the seating position to the water.

The present invention provides a chair configured to be primarily propelled by a user's hands and feet, comprising:

a hull which is arch shaped in plan view, wherein the opposing sides of the arch are formed by one or more streamlined, floats(s); and a central rigid or semi-rigid section fills the area between the sides of the arch shape from the apex which forms the bow of the hull towards the free ends of the arch which form the stern of the hull; and (hereinafter referred to as the stern);

wherein the hull displays a degree of rocker approaching the bow; the lower surface of the central section is a hydrodynamically-efficient shape, describing a smooth, continuous curve from the bow towards the stern and extending to or below the waterline when in use; the upper surface of said central section providing lower and upper-body support for a user, in the form of a seat base between said opposing floats and a seat back adjacent said seat base, said seat back being located between said seat base and the bow; the overall length of the hull being substantially greater than that of the seat base; said hull, said seat base and said seat back being proportioned an dimensioned such that a user sitting on said seat base between the said floats with the user's back against the said seat back may immerse his/her legs below the knee while his/her upper body is supported clear of the water surface, enabling simultaneous immersion of his/her lower legs and hands into the water for propulsion and maneuvering.

Preferably, the or each float extends upwards from the upper surface of the central section to a level at or near the upper surface of user's legs/lower-body in use.

Preferably, the underside of the centre section rises towards the stern to a point at or near the waterline of the chair when in use.

Preferably, the hull also displays a degree of rocker at the stern.

Preferably, said floats extend beyond the stern-most edge of the centre section for a distance greater than 50% of the length of the seat-base.

Preferably, the aspect ratio of the overall length to the width is approximately 1.7–3:1.

Preferably, the overall length of the chair is approximately equal to the face/head height of the typical user (e.g. 1.6–1.8 meters for 1.8–2 meter person).

Preferably, the underside of said floats and said central section is configured to permit surfing or planing.

Preferably, said seat back is upwardly inclined from the said seat base towards the bow.

In one embodiment, both sides of the U-shape may be formed from a single continuous float. The said floats and at least part of the central section may be formed as a single continuous item. Said central section may be made of any suitable semi-rigid or rigid material or combination of same.

In a further embodiment, each opposing side of the U-shape is formed by a single separate float extending substantially parallel to the longitudinal axis of the chair.

Preferably, a releasable restraining means is provided to secure the user to the craft around the user's waist and/or upper thigh area.

Said releasable restraining means may comprise a strap releasably securable across the upper thigh/hip area of each of the user's legs to one or more securing means.

Alternatively, said releasable restraining means may comprise a waist strap and releasable securing means.

Preferably, said floats are proportioned and configured to be stackable or nestable.

In one embodiment, said seat-back is releasably securable to said central section and/or the floats and the inclination of said seat back is adjustable. An inflatable buoyancy means may be provided between the seat-back and the bow.

Preferably, a major portion of the lower surface of the centre section forms a smooth continuous surface with the underside of the floats Alternatively, the underside of the central portion may be recessed upward relative to the underside of said floats.

In a low buoyancy embodiment, the overall buoyancy of the craft may be reduced such that the weigh of water displaced if fully submerged is less than approximately 200% of the user's body weight and/or the buoyancy of each opposing side of the U-shape formed by a single separate float is such that the weight of water displaced if the said float is fully submerged is less than approximately 60% of the user's body weight.

As used herein:

i) The term "U-shaped" is defined as encompassing arch-shaped, V-shaped and any shape including substantially straight, curved, parallel and/or diverging opposing symmetrical limbs or legs and a curved, pointed, or straight transverse connection at one end of the opposing limbs of the U-shape.

ii) The term "rocker" is defined as the upwards curvature or inclination, in a longitudinal direction, of the underside of the craft's hull.

iii) A "semi-rigid or rigid section" is defined s including, foam, solid-skinned or wholly or partially solid section, or any combination of these formed from any suitable material but excluding inflatable construction (except where specifically stated to the contrary).

BRIEF DESCRIPTION OF THE DRAWINGS

By way of example only, a preferred embodiment of the present invention is described in detail with reference to the accompanying drawings, in which.

BEST MODES FOR CARRYING OUT THE INVENTION

Figure 1:
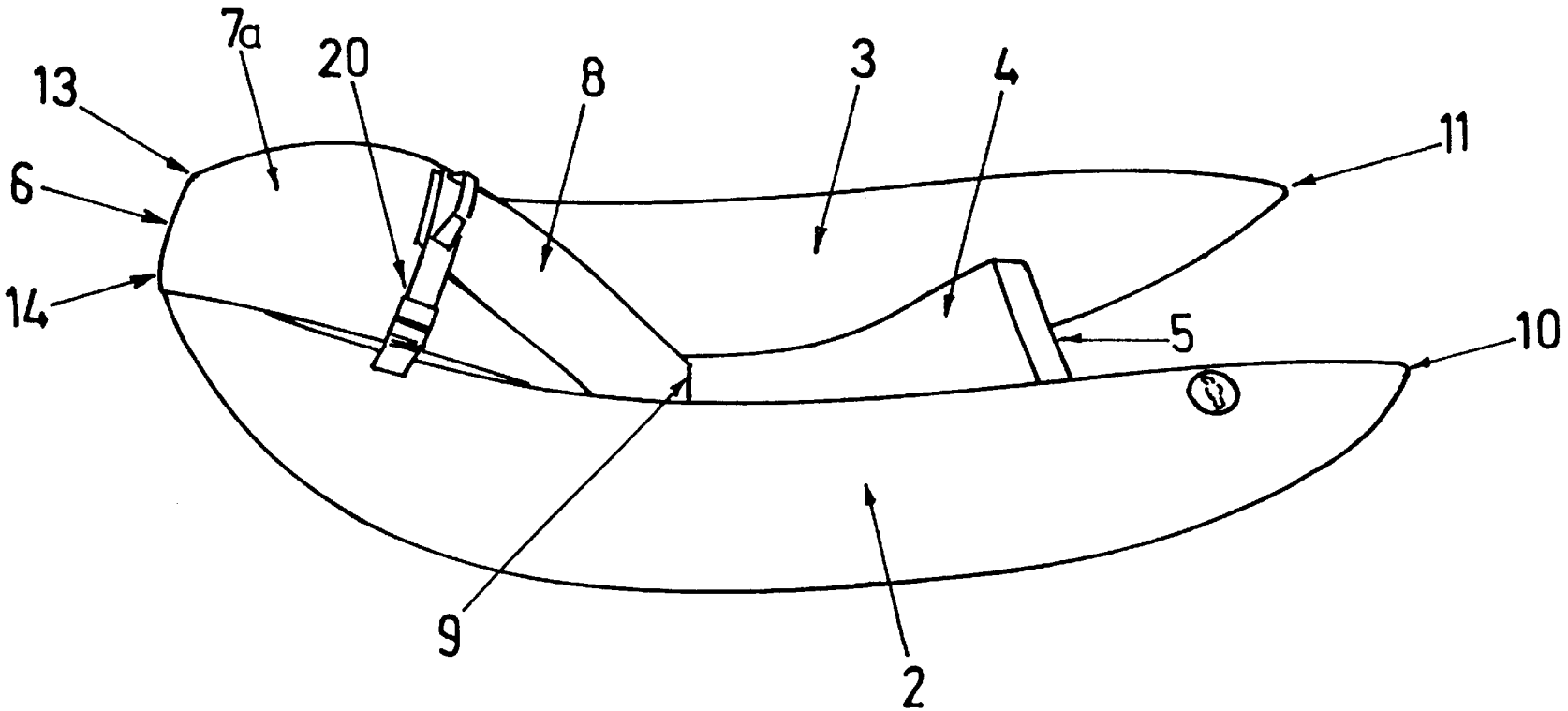
FIG. 1 is a perspective view from above of a first preferred embodiment of the present invention.

Referring to drawings 1–5, a first embodiment of the U-shaped chair is comprised of two inflatable floats (2 & 3), a semi-rigid seat base (4), an adjustable seat-back (8), a bow hull floor section (12), a hull skin section (15*a*), an inflatable buoyancy bag (16) and a waterproof covering (7).

The two inflatable floats (2 & 3) are circular in cross-section and taper at both ends to conical points (10 & 11) at the tern and (13 & 14) at the bow. The longitudinal axes of the inflatable tubes (2 & 3) are orientated to converge towards the bow (6), (although they do not meet in this preferred embodiment) and are substantially parallel towards the stern.

Figure 4:
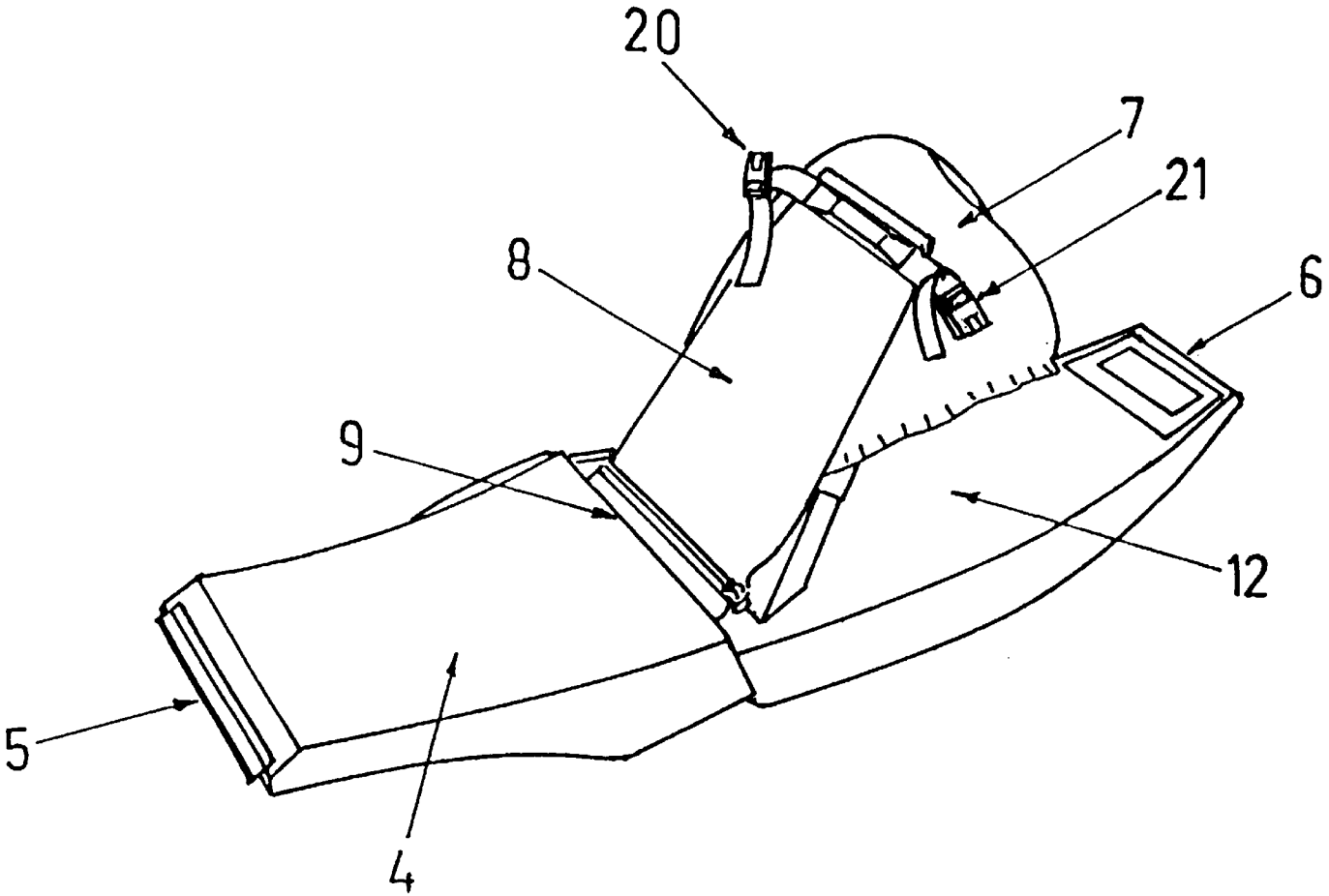
FIG. 4 is a perspective view of the seat components and semi-rigid central section removed from the chair of a first preferred embodiment of the present invention.

The hull skin section (15*a*) is permanently fixed (e.g. stitched, glued or, heat-welded) to the floats (2 & 3). As shown in FIG. 4 the seat-base (4) and the bow hull floor section (12) are hinged together (to enable them to be dismantled and compactly folded) and are secured (e.g. zip, clips) to the aft-edge (5) of the hull skin section (15*a*) and pushed between (and extend slightly under) the floats (2 & 3) and secured at the bow (6) by a hook-and-loop fastening. Alternatively, the seal-base (4), bow hull floor section (12) and the hull skin section (15*a*) may be combined together and attached to the floats (2 & 3) by longitudinal fastenings (not shown). In both alternatives, the seat-base (4) and bow hull floor section (12) are made from a semi-rigid foam.

A central section (15) formed from the combination of the hull skin section (15*a*) enclosing the area between the floats (2 & 3) and the attached seat-base (4) and bow hull floor section (12), delineates a smooth curve from the bow (6) extending below the water surface and rising to the edge of the seat base (5) which is approximately level with the water-line of the chair when in use. The underwater surface of both the floats (2 & 3) and the central section (15) is free from any protuberance or distortion and is conducive to maximising the hydrodynamic efficiency and lateral stability of the chair. The lower surface of the said central section (15) of the chair (i.e. the hull skin section (15*a*)) and the outer surface of the floats (2 & 3) form a single smooth continuous surface for a major portion of the length of the centre section and are made of a water-impervious, abrasion resistant flexible material such as PVC coated nylon or polyester.

A near rectangular, semi rigid foam seat-back (8) with a covering, is zipped to the intersection (9) of the seat-base (4) and the bow hull floor section (12). The angle of inclination of the seat-back may be varied by adjusting straps (20 & 21) fixed from the side of the seat-back (8) to the floats (2 & 3) and/or adjusting the volume of an inflatable buoyancy bag (16) placed between the seat-back (8) and the bow hull floor section (12). An elastic-edged covering flap (7) is attached to the top of the seat-back (8) and stretches over the adjustable buoyancy bag (16) to the bow (6) where it is attached by an adjustable strap (19) or similar fastening.

Alternatively the seat-back (8) may be adjustably secured to the seat-base/bow hull floor section (4,12) or to the sides of the floats (2 & 3) to enable its longitudinal position to be adjusted. This permits users of differing physical stature to use the float.

Preferably the user's knee will extend to a point just past the seat-base edge (5) enabling the portion of the legs below the knee to kick or float in the water. The floats (2 & 3) extend rearwards beyond the seat-base edge (5) for a distance greater than 50% of the length of the seat base 4, and preferably between 50% and 80% of said length. This distance is approximately equal to the position of the ankles of the extended leg of the seated user. This enables the float to provide sufficient buoyancy in the stern (preventing/minimising the likelihood of pitchpollng) whilst not hindering the use of the feet for kicking (with fins) or for fending-off boulders, rocks and similar obstacles.

The length to width aspect ratio is a critical design consideration which has ben found to have an optimum value of approximately 1.7–3:1. The overall length itself is also an important parameter and should ideally be approximately equal to the height of the face/head, e.g. approximately 1.6–1.8 meters of a typical 1.8–2 meter user. These values will naturally alter with users of different stature, requiring chairs of different sizes to be produced for optimum performance.

The combination of the relatively long overall length together with extension of the floats (2 & 3) past the seat-base edge (5) provides a stale platform for the user to climb into the seat from the water without the chair tipping or flipping over.

The semi-reclining seat configuration and rigid or semi-rigid centre section provide the following advantages:

(i) Support, stability and comfort, enabling practical use for extended periods.

(ii) Places the user's legs in the optimum position for kicking, floating on the water surface, minimising drag, avoiding submerged hazards and for fending off rocks, boulders etc.

(iii) Efficient use of the user's arms for paddling—both forwards and reverse, enhanced by their ergonomically efficient position and close proximity to the water surface aided by the relatively narrow diameter of the tubes allowing the user to easily reach over the sides.

(iv) Minimises transom drag.

(v) A low centre of gravity, thus increasing stability.

(vi) Decreasing any tendency of the user to slide out of the open stern in turbulent water.

(vii) Lateral stiffness, preventing the floats (2 & 3) collapsing towards each other under the weigh of the user and enhancing the overall structural integrity of the float.

(viii) The curved underwater profile prevents rocks/obstructions snagging and minimises the likelihood of damage, in both directions of travel.

(ix) Absorbs shock and protects the user's body between the midriff and the knees from any underwater collisions.

(x) The user is able to pivot (with the assistance of waist and legs straps) and also has the freedom to move the upper body fore and aft to balance and tilt the chair longitudinally The volume between the seat back (8) and the hull floor is filled by the removable, inflatable buoyancy bag (16). After inflation, the bag completely fills the space behind the seat back (8), displacing any water that might otherwise settle there. This prevents any water splashing into the chair from being retained, as the buoyancy bag and the user's body fills all the available cavities/apertures and thus the float is in effect self-draining.

Equipment may be stored behind the seat-back (8),—preferably in a waterproof bag displacing part of the volume of inflated bag (16) and is retained in position by cover flap (7).

The user may be secured to the chair by means of quick-release straps (22 & 23). This enables the user to perform a variety of vigorous manoeuvres without becoming detached from the chair.

A number of handles (not shown) can be located along the upper surface of the floats (2, 3) for use in turbulent waters by users not secured to the chair by said straps (22, 23) or similar means. Handles located near the ends (10, 11) an middle of floats (2, 3) aid re-entry of the chair by a person in the water. All handles improve the general handling and transportation of the chair out of the water.

It will be appreciated that by varying the cross-sectional area of the floats (2 & 3) and therefore varying their buoyancy, the performance and response characteristics of the float can be altered.

Increasing the cross-sectional area of the floats (2 & 3) increases the overall stability and buoyancy of the float, minimising the risk of inversion. This would be desirable for heavier or less experienced users, or for example for use in a commercial hire operation, where safety is paramount.

Decreasing the diameter of the floats reduces the overall stability and buoyancy of the chair, particularly the lateral stability, whilst increasing the ability to bank and roll. This enables experienced users to perform more advanced maneuvers such as Eskimo rolls.

Figure 5:
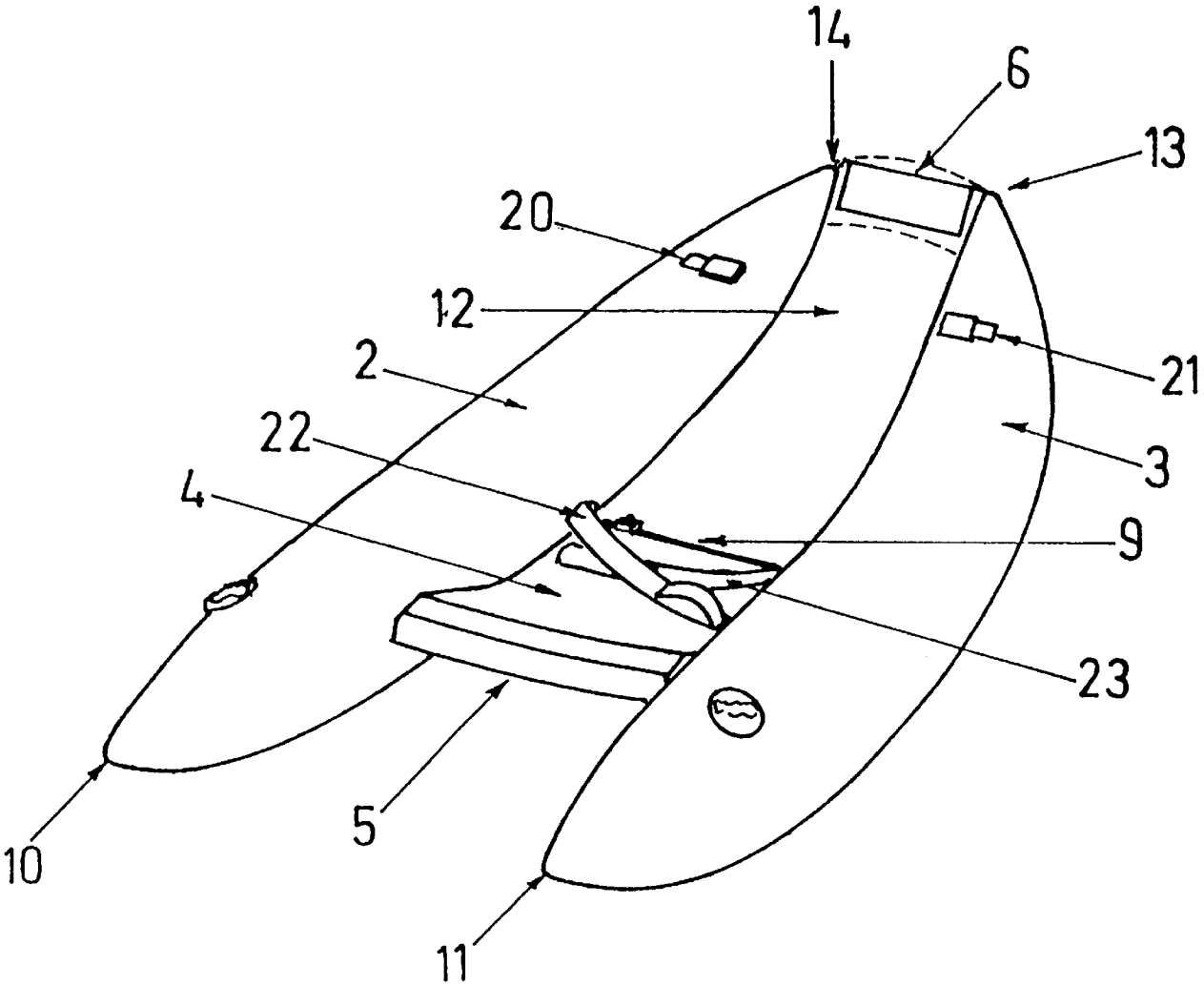
FIG. 5 is a further perspective view of an embodiment shown only the seat-base and bow-hull floor sections; an alternative embodiment is shown in broken lines.

In a second preferred embodiment (shown in broken lines in FIG. 5) the floats (2 & 3) contain a small junction at the bow (located above the waterline) enabling the simultaneous inflation of both floats (2 & 3) via a single inlet valve. Substantially increasing the size of this inflatable junction between the floats (2 & 3) would enable its use as a seat-back, thus dispensing with the need for the removable seat-back (8) and buoyancy bag (16).

Figure 7:
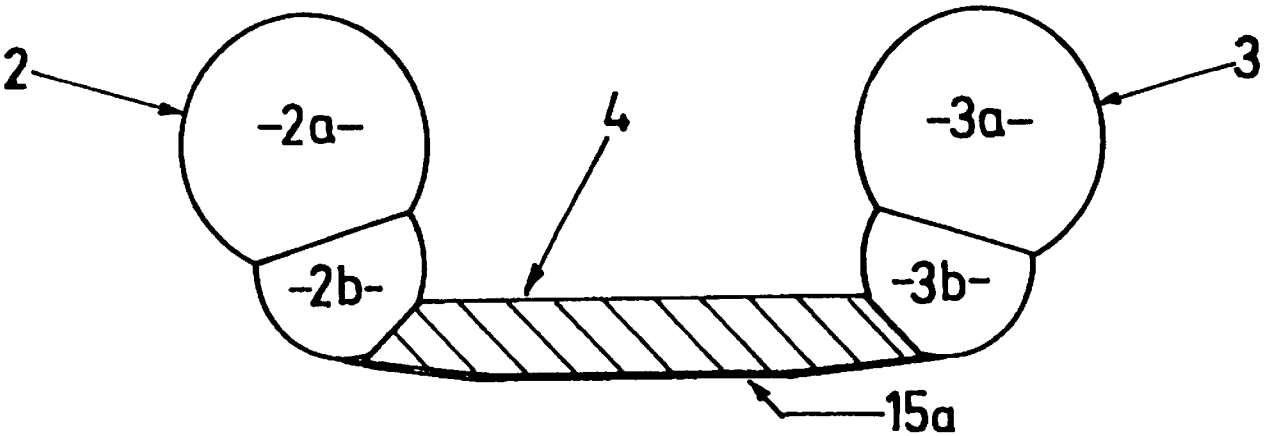
FIG. 7 shows a corresponding view to FIG. 6 of a further preferred embodiment.

In a third preferred embodiment (as shown in FIG. 7), each float (2 & 3) may be comprised of two or more inflatable tubes (2*a*, 2*b*,3*a*,3*b*) with common adjoining walls. This configuration permits the diameter of the individual tubes to be reduced without necessarily reducing their combined cross sectional height. Different lateral cross-sectional profiles may be achieved by joining tubes of different diameters in various positions.

Figure 2:
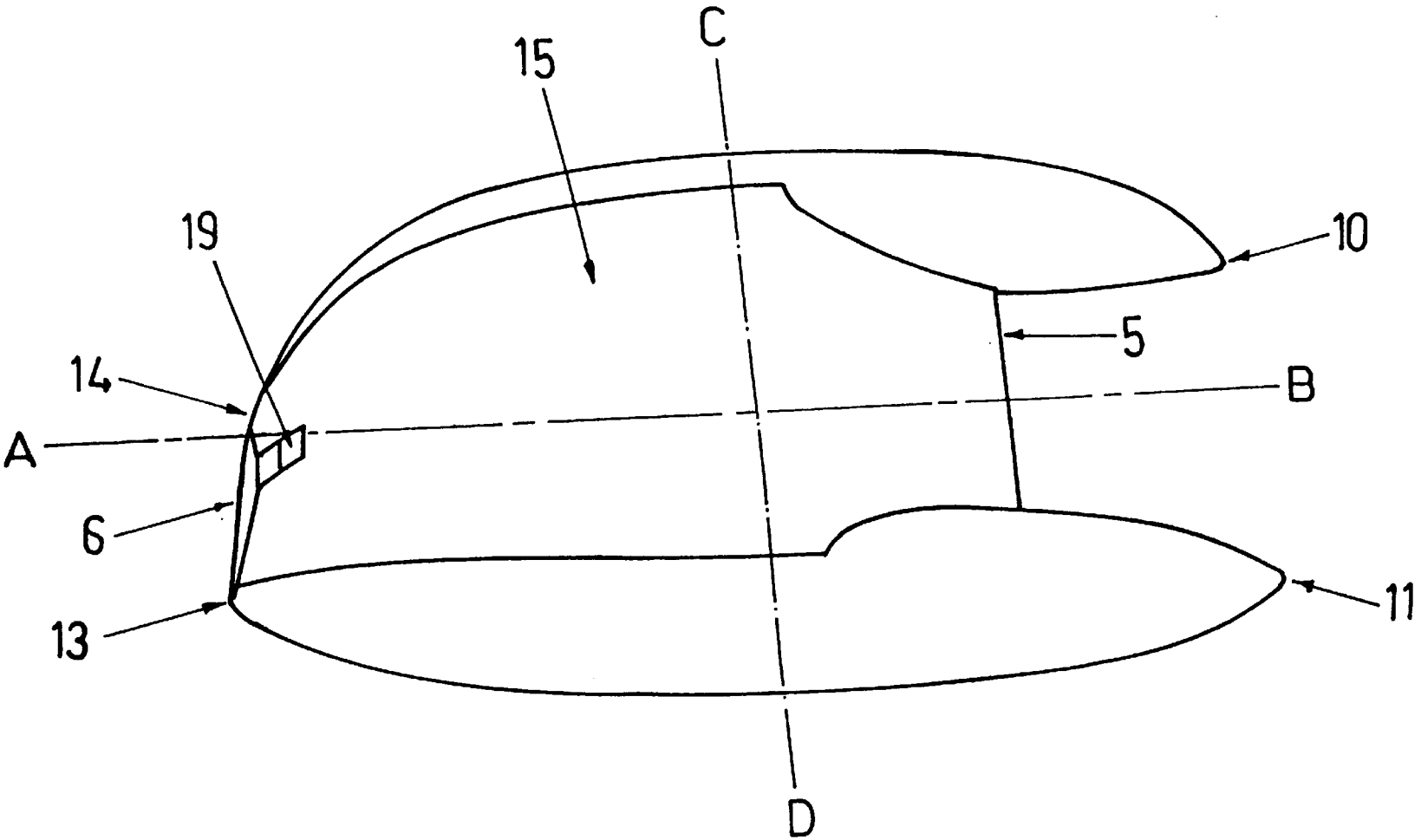
FIG. 2 is a perspective view from below of embodiment of the present invention shown in FIG. 1.
Figure 6:
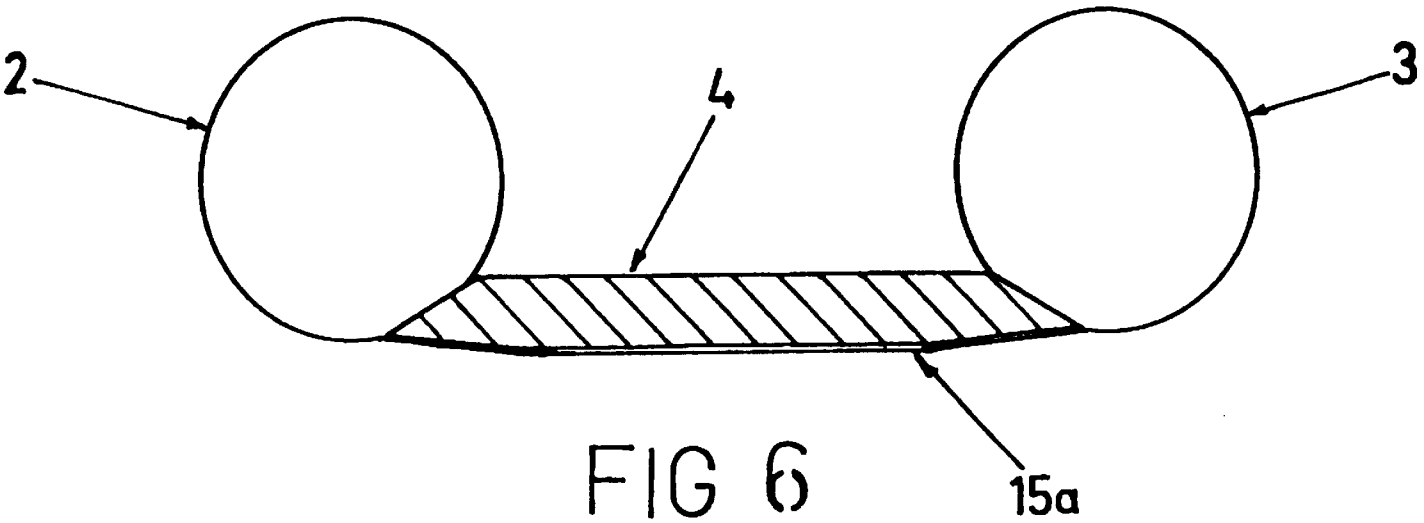
FIG. 6 shows a section through line C-D of FIG. 2.

This may be readily discerned by a comparison of FIG. 6 (showing a cross-section through the line C-D of FIG. 2) and the corresponding cross-section of the third embodiment (which includes the additional tubes 2*b* and 2*c*) as shown in FIG. 7. Thus, it can be seen that floats (2 & 3) in FIG. 7 have a reduced diameter compared to that of the first and second preferred embodiment shown in FIG. 6. The additional floats (2*b* & 3*b*) are located below floats (2*a* & 3*a*) with their longitudinal axes closer inboard to the longitudinal axes of the chair than floats (2*a* & 3*a*). This float configuration retains a similar (or greater) cross sectional height to the same first/second preferred embodiments, but reduces the floats' overall width and buoyancy. The additional floats (2*b* & 3*b*) do not extend as separate identities for the entire length of the floats (2*a* & 3*a*), but merge with them at the bow and stern to form conical points.

All the aforesaid embodiments utilising an inflatable construction may also be formed with a rigid or semi-rigid construction described in more detail as follows. The same reference numerals re used to denote items common to both the inflatable and non-inflatable embodiments.

Referring to drawings 1–5, a fourth preferred embodiment of the substantially U-shaped chair is shown, comprised of two rigid/semi-rigid floats (2, 3), a seat base (4), a seat-back (8), a bow hull floor section (12) and a hull skin section (15*a*) which is substantially equivalent in exterior shape to the first preferred, with the exception that the floats (2, 3) are either rigid or semi-rigid in construction and not inflatable and that the inflatable buoyancy bag and waterproof covering is replaced by a rigid waterproof enclosure with a releasable access hatch/cover (in the area indicated by arrow (7*a*)). Rigid floats (2, 3) could be produced from a thermoplastic material by roto-moulding or similar means, whereas semi-rigid floats (2, 3) may be formed as semi-flexible tubes filled with a closed-cell foam (e.g. polyolefin). This structure provides the required degree of rigidity whilst still maintaining a resilient outer surface, thus dampening the shock of any impact with a rock or similar when in use. Furthermore, the craft would remain buoyant, despite any penetration of the outer skin.

The two floats (2, 3) are shown as being circular in cross-section and tapering at both ends to conical points (10, 11) at the stern and (13, 14) at the bow, though it will be appreciated that any cross-sectional/longitudinal shape is possible with a rigid /semi-rigid construction. Once freed from the shape constraints imposed by an inflatable construction, any chosen shape may be readily reproduced from a suitable mould. The longitudinal axes of the float tubes (2, 3) are orientated to converge towards the bow (6), (although they do not meet in this preferred embodiment) and are substantially parallel towards the stern.

Figure 8:
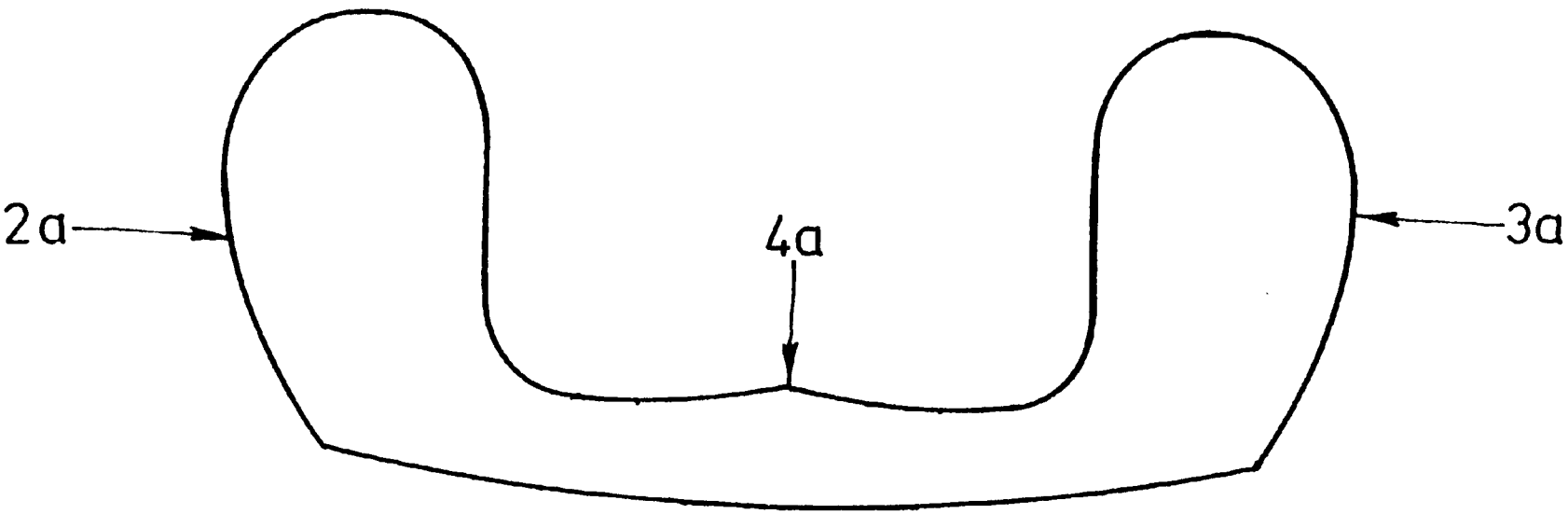
FIG. 8 shows a corresponding view to FIG. 6 of a further preferred embodiment

In the fourth preferred embodiment shown in FIGS. 1–5, the hull skin section (15*a*), the seat-base (4) and the bow hull floor section (12) (as described above in the first preferred embodiment) are preferably formed as a single continuous moulding together with floats (2, 3). In the case of a rigid construction, the upper surface of the seat-base (4) could be covered with a semi-rigid layer of padding such as a foam rubber. Similarly, the sides of the floats (2, 3) adjacent to the user's upper legs/lower torso could be padded in a corresponding manner. FIGS. 6 and 8 show respectively, a comparison between the lateral cross section (taken through the seat-base (4) along line C-D shown in FIG. 2) of the aforesaid embodiment with a separate seat-base (4) (FIG. 5) and the preferred embodiment with a continuous integrally-moulded seat-base/floats assembly (2*a*,3*a*,4*a*). The underwater profile of the central section (15) may be formed with an even more streamlined shape and finish than is possible for the said inflatable chair.

In the preferred form of the fourth embodiment, the seat-back (8) is also integrally moulded with the floats/central section assembly (2*a*, 3*a*, 15) and is comprised of a near-rectangular section contoured to the shape of a user's back and upwardly inclined towards the bow from the intersection (9) with the seat-base (4).

Figure 3:
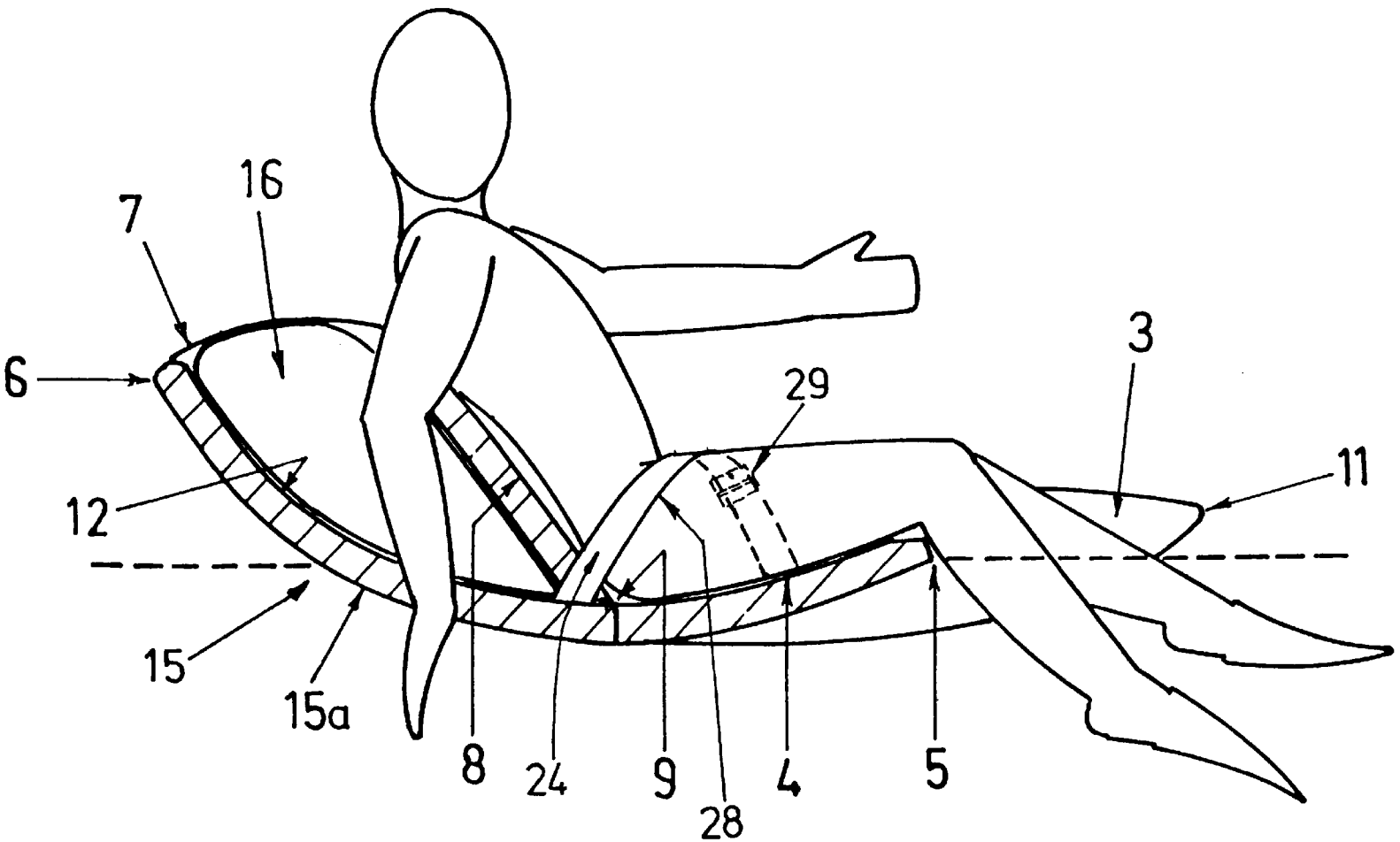
FIG. 3 is a section through line A-B of FIG. 2 (shown inverted) with a human user shown in phantom.

In a fifth embodiment, shown in FIG. 3., the seat-back (8) may be formed as a distinct, adjustable, semi-rigid foam seat-back, which is zipped to the intersection (9) (as disclosed in the first preferred embodiment ). The volume between the seat back (8) and the bow-hull floor section (12) is filled by the removable, inflatable buoyancy bag (16) and/or cargo. In this embodiment, the use of inflatable buoyancy bag (16) and the possible adjustments to the seat-back (8) (including adjusting straps (20, 21) and all other related paraphernalia) correspond directly to the aforesaid description in the first embodiment It has been found in practice that a reduced buoyancy embodiment (a sixth preferred embodiment) provides the more ambitious/experience user with a range of dynamic manoeuvres that would be difficult with a more stable buoyant chair. The ability to hand-roll the chair is particular important as it enables the user to safely remain in the chair, despite a capsize. Naturally, the ability to execute such a manoeuvre is enhanced by securing the user to the chair in some way.

Whilst the simple quick release straps (22, 23) located across the user's waist are sufficient (and indeed optional) for a stable high buoyancy embodiment of the chair, a more secure means of restraint is required for a low buoyancy embodiment. This is provided by a releasable restraining means (24) which take any suitable form. In one embodiment, the releasable restraining means (24) comprises a strap (28) (as shown in FIG. 3) releasably securable to one or more securing means (29) across the upper thigh/hip area of each of the user's legs. The securing means (29) can take any convenient form such as a single claps, buckle, or of the like, able to simultaneously release both the legs straps (28), or individual buckles or similar requiring independent release of each legs straps (28). It will be appreciated that the quick release nature of the restraining means is paramount given that the user may well be inverted underwater attempting to release themselves from the chair.

In general terms, hand rolling of the chair may only be reliably achieved below a certain degree of buoyancy. Whilst differing ability and experience of the user is obviously an important factor, two approximate indications of the ability to hand-roll are:

- when the weight of water displaced by the whole chair if fully submerged is less than approximately 200% of the user's body weight and
- when the buoyancy of each opposing side of the U-shape formed by a single separate float (2, 3) is such that the weight of water displaced if the said float is fully submerged is less than approximately 60% of the user's body weight.

Figure 9:
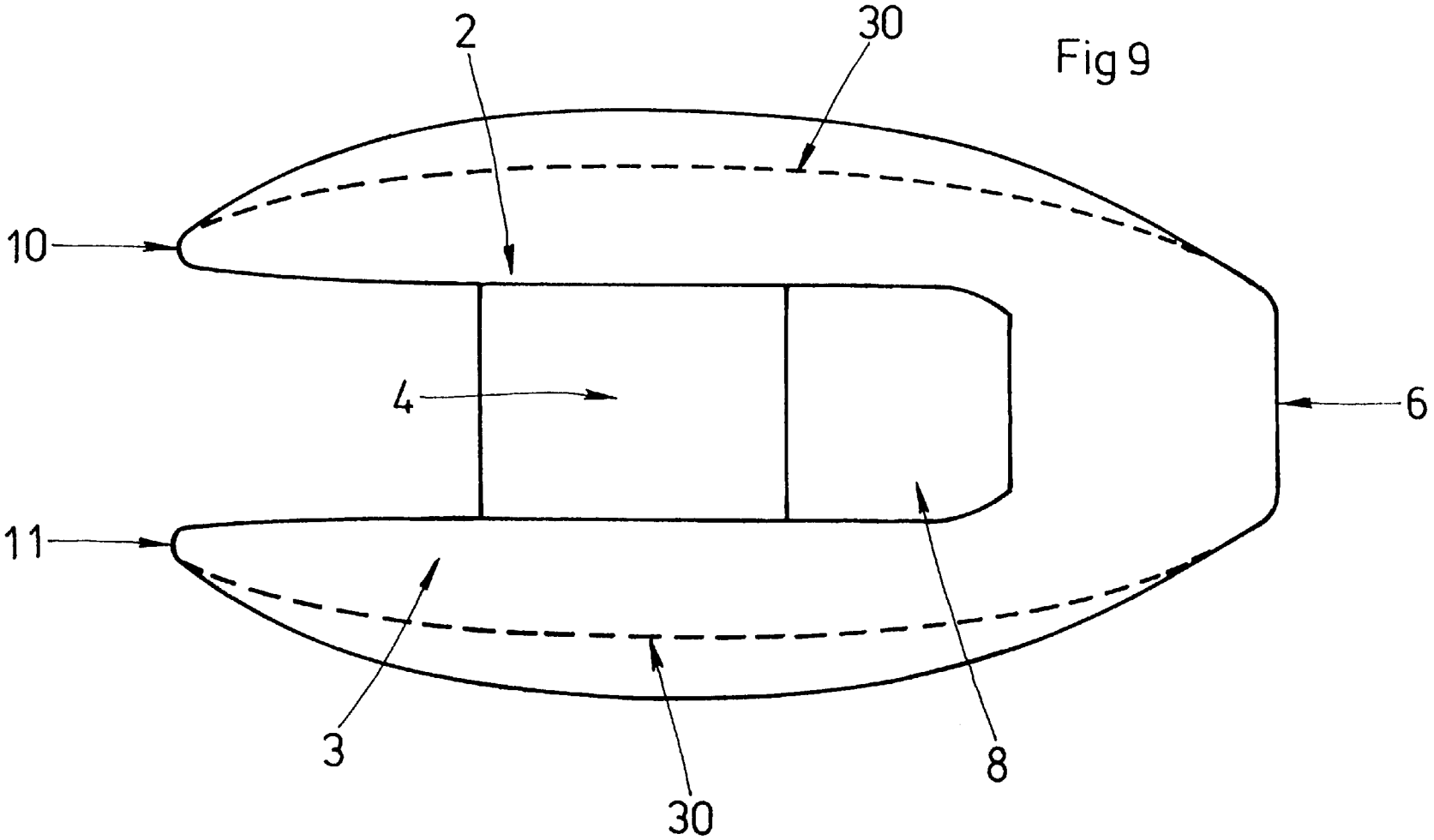
FIG. 9 shows a plan view of the preferred embodiment shown in FIG. 1, with a further preferred embodiment represented by a dotted line.

The above comments assume the use of webbed gloves by the user, without which hand rolling would be far more difficult. The reduced cross-sectional area (and consequently a reduced width) of the floats (2,3) (as shown in FIG. 8) of a low buoyancy non-inflatable embodiment would produce a substantially parallel sided U-shaped hull (in plan view) from the stern to the region adjacent the user's chest/shoulders. FIG. 8 shows a plan view of the first preferred embodiment with the periphery of the low buoyancy sixth embodiment denoted by a dotted line (30). Provided the bow hull floor section (12) still maintained a hydrodynamically efficient side profile, a substantially straight, blunt-ended parallel-sided U-shape (as shown in FIG. 9) would be possible. However, the requirement would still exist for the user to be able to immerse (for paddling) their hand/slower arms whilst reclining on the seat back (8).

Any of the above embodiments (particularly the low buoyancy embodiment) may be used in an indoor swimming pool or similar for games such as an adaption of water-polo.

Figure 10:
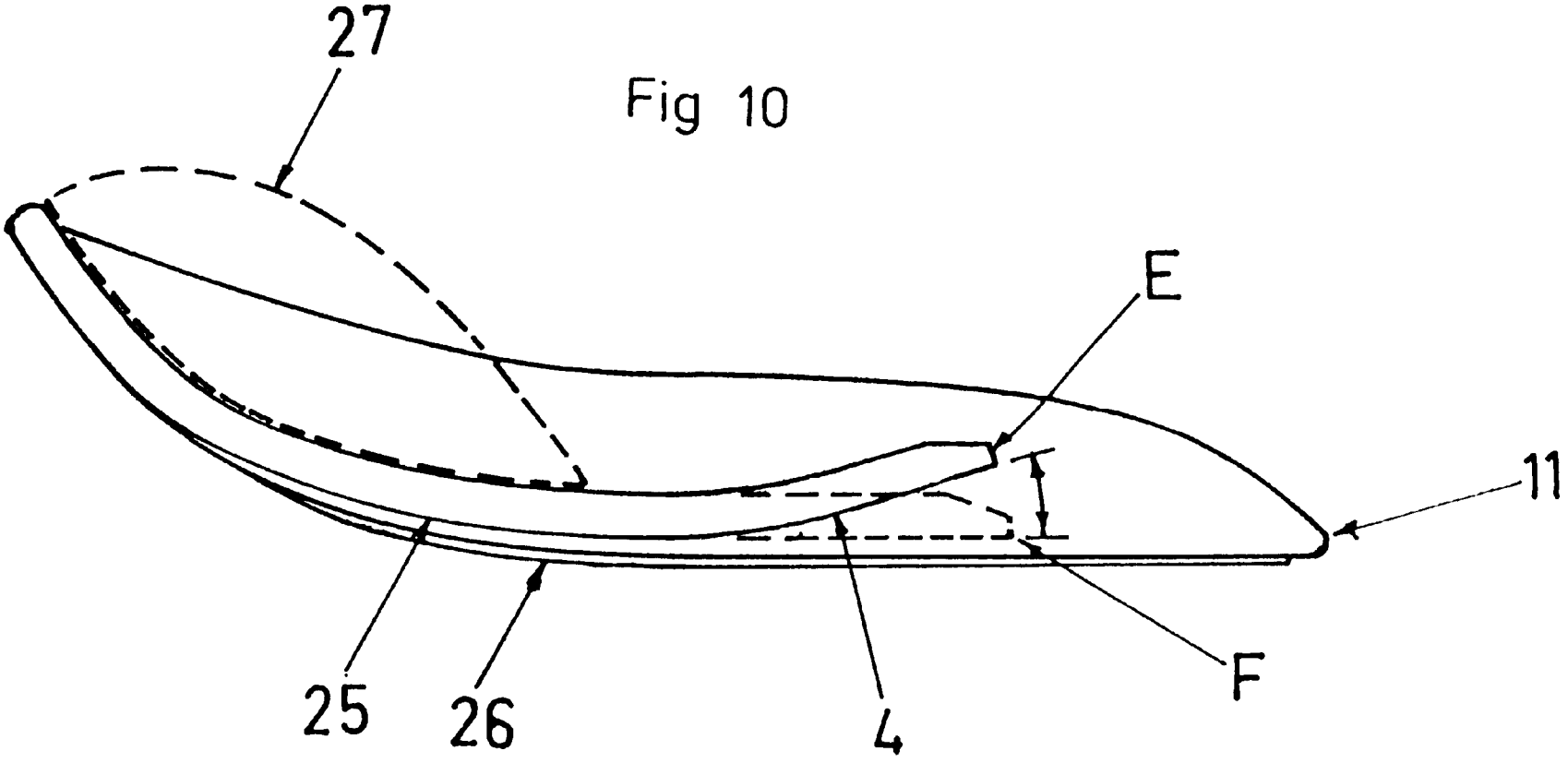
FIG. 10 shows a corresponding view to FIG. 3 of a further preferred embodiment.

In a seventh embodiment, (as shown in FIG. 10) the chair is optimised for use on snow or for towing across water. In this embodiment, the chair is configured such that the underside of the seat-base (4) is ideally raised slightly form a line drawn tangentially between floats (2, 3), wherein said floats maintain a flat hull profile, aft of the seat base/seat back intersection (9), i.e. no rocker in the stern. The floats (2,3) would thus act as 'rails' in this embodiment.

This may be achieved by replacing the curved seat-base (4), with a flat base or by the use of suitable adjustable fastening means on floats (2, 3), altering the angle of seat-base (4) between positions E (raised towards the stern) or F (parallel to the water's surface). The characteristic features of the fourth preferred embodiment in comparison to the above described embodiments are;

no rocker at the stern, a slightly raised centre section (25) with respect to the bottom of floats (2, 3), a longitudinal ridge (26) for directional stability on each float (2, 3) and a simplified cushion/support pillow (27) replacing the seat back/buoyancy bag (8, 16) assembly.

This configuration would also enable the user to adopt a prone position facing the bow.

It will be further appreciated that there are a variety of different configurations possible for all the embodiments by altering the geometry of the floats, the size and arrangement of the chair elements and the construction means/materials. The angular relation of the centre line of the legs of the U-shaped hull can range from being substantially parallel to converging at either bow or stern or both.

In practice it has been found that on flat and/or slow moving water, the chair is paddled by the hands and/or feet in a bow-firs direction. In fast flowing/white-water, the user faces downstream (i.e. stern first) being carried by the current, and propels himself (using his legs and/or hands) at an angle against the current (ferry glide) as a means to navigate left or right to avoid hazards.

All the embodiments of the chair can also be used in a similar fashion to body-board, with the user adopting a prone position facing the bow. Straps (20) or handles (not shown) located adjacent to strap (20) can be used by the user as a secure hand-hold in this body position.

The shape of the float under-side, particularly at the bow, promotes the ability to surf/plane on waves, especially the type of standing waves produced in some white-water and/or rapid rivers.

It will be appreciated that it is desirable for storage and/or transport that the chair be stackable or nestable and thus occupying a reduced volume. Both the inflatable and non-inflatable versions may be stacked by reversing alternate chairs such the seat-back (8) of one chair may be inserted between the free ends of the floats (2,3) at the stern of another chair. Due to the greater variety of shapes and configurations possible, the non-inflatable chair may be more readily adapted to form more intimate stacking than the inflatable version.

What is claimed is:

1. A chair configured to be primarily propelled by a user's hands and legs, comprising:

a hull which is arch-shaped in plan view, wherein the opposing sides of the arch are formed by one or more streamlined, float(s) and a central semi-rigid or rigid section fills the area between the sides of the arch-shape from the apex which forms the bow of the hull, towards the free ends of the arch which form the stern of the hull;

and wherein the hull displays a degree of rocker approaching the bow; the lower surface of the central section is a hydrodynamically-efficient shape, describing a smooth, continuous curve from the bow towards the stern and extending to or below the waterline when in use; the upper surface of said central section providing lower and upper-body support for a user, in the form of a seat base between said floats and a seat back adjacent said seat base, said seat back being located between said seat base and the bow; the overall length of the hull being substantially greater than that of the seat base; said hull, said seat base and said seat back being proportioned and dimensioned such that a user sitting on said seat base between the said floats with the user's back against the said seat back may immerse his/her legs below the knee while his/her upper body is supported clear of the water surface, enabling simultaneous immersion of his/her lower legs and hands into the water for propulsion and manoeuvring.

2. A chair as claimed in claim 1, wherein the underside of the centre section rises towards the stern to a point at or near the waterline of the chair when in use.

3. A chair as claimed in claim 1, wherein the hull also displays a degree of rocker a the stern.

4. A chair as claimed in claim 1, wherein the or each float extends upwards from the upper surface of the central section to a level at or just above the user's legs/lower-body in use.

5. A chair as claimed in clam 1, wherein the inclination of said seat back is adjustable.

6. A chair as claimed in claim 1, wherein the seat-back is releasably securable to said central section and/or the floats.

7. A chair as claimed in any one of the preceding claims, wherein said floats extend beyond the stern-most edge of the centre section for a distance greater than 50% of the length of the seat base.

8. A chair as claimed in any one of claims 1–6, wherein the aspect ratio of the overall length to the width is approximately 1.7:1 to 3:1.

9. A chair as claimed in claim 7, wherein the aspect ratio of the overall length to the width is approximately 1.7:1 to 3:1.

10. A chair as claimed in claim 1, wherein the overall length of the chair is approximately equal to the face/head height of a typical user.

11. A chair as claimed in claim 1, wherein an inflatable buoyancy means is inserted between the seat-back and the bow.

12. A chair as claimed in claim 6, wherein each opposing side of the U-shape is formed by a single separate float.

13. A chair as claimed in claim 7, wherein each opposing side of the U-shape is formed by a single separate float.

14. A chair as claimed in any one of claim 1–6, 10, 11, wherein both sides of the u-shape are formed from a single continuous float.

15. A chair as claimed in claim 1, wherein at least part of said central section is inflatable.

16. A chair as claimed in any one of claims 1–6, 10–12, 15, wherein at lest part of said central section is made of foam material.

17. A chair as claimed in any one of claims 1–6, 10–12, 15, wherein at lest part of said central section is made of a plastics material.

18. A chair as claimed in any one of claims 1–6, 10–12, 15, wherein a major portion of the lower surface of the centre section forms a smooth continuous surface with the underside of the floats.

19. A chair as claimed in any one of claim 1–6, 10–12, 15, wherein the underside of the central portion is recessed upwards relative to the underside of said floats.

20. A chair as claimed in any one of claims 1–6, 10–12, 15, wherein the underside of said floats and said central section is configured to permit surfing or planing.

21. A chair as claimed in any one of claims 1–6, 10–12, 15 wherein at least part of the said central section is made from shock absorbent material.

22. A chair as claimed in any one of claims 1–6, 10–12, 15, wherein said seat back is upwardly inclined from the said seat base towards the bow.

23. A chair as claimed in any one of claims 1–6, 10–12, 15 wherein said floats and at least part of the central section are formed as a single continuous item.

24. A chair as claimed in claim 12, wherein the buoyancy of a single said float is such that the weight of water displaced if the said float is fully submerged is less than approximately 60% of the user's body weight.

25. A chair as claimed in any one of claims 1–6, 10–12, 15, 24, wherein the overall buoyancy of the chair is such that the weight of water displaced if the chair is fully submerged is less than approximately 200% of the user's body weight.

26. A chair as claimed in any one of claims 1–6, 10–12, 15, 24, wherein a releasable restraining means is provided to secure the user to the craft around the user's waist and/or upper thigh area.

27. A chair as claimed in claim 1, wherein said releasable restraining means comprises a strap, releasably securable across the upper thigh/hip area of each of the user's legs to one or more securing means.

28. A chair as claimed in claim 1, wherein said releasable restraining means comprises a waist strap and releasable securing means.

29. A chair as claimed in any one of claims 1–6, 10–12, 15, 24, 27, 28, proportioned and configured such that a plurality of chairs are stackable or nestable.

* * * * *

UNITED STATES PATENT AND TRADEMARK OFFICE

CERTIFICATE OF CORRECTION

PATENT NO. : 6,227,925 B1
DATED : May 8, 2001
INVENTOR(S) : Graeme James Boddy

It is certified that error appears in the above-identified patent and that said Letters Patent is hereby corrected as shown below:

Column 12, claim 12,
Line 1, change "claim 6" to -- claim 1 --

Signed and Sealed this

Twenty-sixth Day of February, 2002

*Attest:*

*Attesting Officer*

JAMES E. ROGAN
*Director of the United States Patent and Trademark Office*